United States Patent [19]

Ostertag et al.

[11] Patent Number: 4,878,548

[45] Date of Patent: Nov. 7, 1989

[54] NOZZLE RETENTION SYSTEM FOR A DRILL BIT

[75] Inventors: Alfred Ostertag, Celle, Fed. Rep. of Germany; Robert E. Iversen, Humble, Tex.; Craig R. Hyland, Magna, Utah; Kenneth D. Enever, Lisses, France; Steven R. Radford, South Jordan, Utah

[73] Assignee: Eastman Christensen, Salt Lake City, Utah

[21] Appl. No.: 146,377

[22] Filed: Jan. 21, 1988

[51] Int. Cl.[4] ..... E21B 10/18; E21B 10/60

[52] U.S. Cl. ..... 175/340; 175/393; 175/424; 239/600; 408/60; 408/61

[58] Field of Search ..... 175/339, 340, 393, 424; 299/81; 239/600; 408/60, 61; 76/108 R, 108 A, 101 E; 285/376, 401

[56] References Cited

U.S. PATENT DOCUMENTS

| | | | |
|---|---|---|---|
| 2,520,362 | 8/1950 | Goolsbee | 285/163 |
| 2,525,667 | 10/1950 | Goolsbee et al. | 175/340 |
| 2,531,749 | 11/1950 | Stokes et al. | 285/163 |
| 2,868,512 | 1/1959 | Sease | 255/314 |
| 2,885,182 | 5/1959 | Hammer | 255/314 |
| 2,885,186 | 10/1958 | Payne | 255/314 |
| 2,950,090 | 8/1960 | Swart | 255/314 |
| 3,084,751 | 4/1963 | Scarborough | 175/340 |
| 3,111,179 | 11/1963 | Albers et al. | 175/393 |
| 3,115,200 | 12/1963 | Mandrell | 175/340 |
| 3,129,777 | 4/1964 | Haspert | 175/340 |
| 3,137,354 | 6/1964 | Crawford et al. | 175/340 |
| 3,220,754 | 11/1965 | Mori | 285/305 |
| 3,329,222 | 7/1967 | Neilson | 175/340 |
| 3,389,759 | 6/1968 | Mori et al. | 175/258 |
| 3,393,756 | 7/1968 | Mori | 175/258 |
| 3,424,255 | 1/1969 | Mori et al. | 175/60 |
| 3,688,853 | 9/1972 | Maurer et al. | 175/422 |
| 3,702,708 | 11/1972 | Moore | 285/376 X |
| 3,744,581 | 7/1973 | Moore | 175/242 X |
| 3,858,910 | 1/1975 | Oetiker | 285/376 X |
| 4,019,593 | 4/1977 | Craig | 175/340 |
| 4,185,781 | 1/1980 | O'Brien | 239/600 |
| 4,381,825 | 5/1983 | Radtke | 175/393 |
| 4,392,534 | 7/1983 | Miida | 175/393 X |
| 4,400,024 | 8/1983 | Ratcliff et al. | 285/356 |
| 4,407,378 | 10/1983 | Thomas | 175/340 |
| 4,427,221 | 1/1984 | Shay, Jr. | 285/305 |
| 4,438,884 | 3/1984 | O'Brien et al. | 339/600 |
| 4,603,750 | 8/1986 | Sorenson | 175/340 |
| 4,611,672 | 9/1986 | Hölzl | 175/339 |

FOREIGN PATENT DOCUMENTS

| | | | |
|---|---|---|---|
| 0901456 | 1/1982 | U.S.S.R. | 175/340 |

*Primary Examiner*—Bruce M. Kisliuk

*Attorney, Agent, or Firm*—Arnold, White & Durkee

[57] ABSTRACT

A nozzle retention system for a drill bit which includes a nozzle member which is retained by means of a keyway in the bit body. The bit body can include a partially cylindrical bore, truncated by opposing walls to form a lower contact surface within the bit body. The nozzle will be conformed to pass through the bore in a first orientation, and to be retained in the bore and against such contact surface when the nozzle is rotated to the second orientation.

16 Claims, 4 Drawing Sheets

Fig. 4
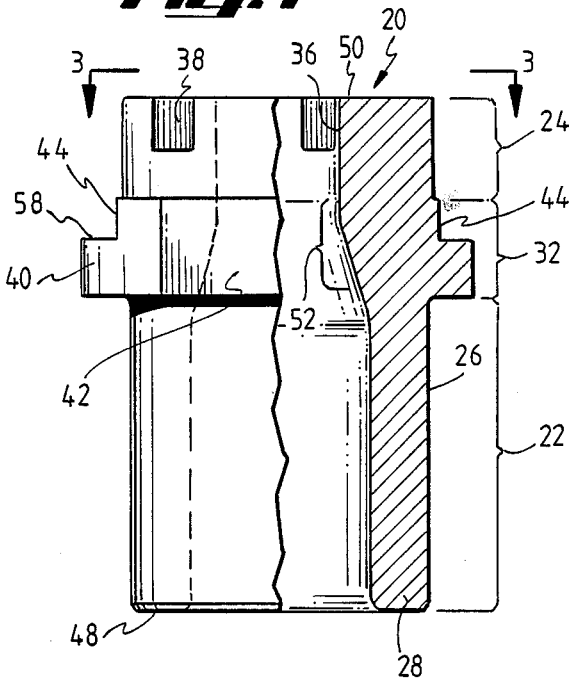
Fig. 2
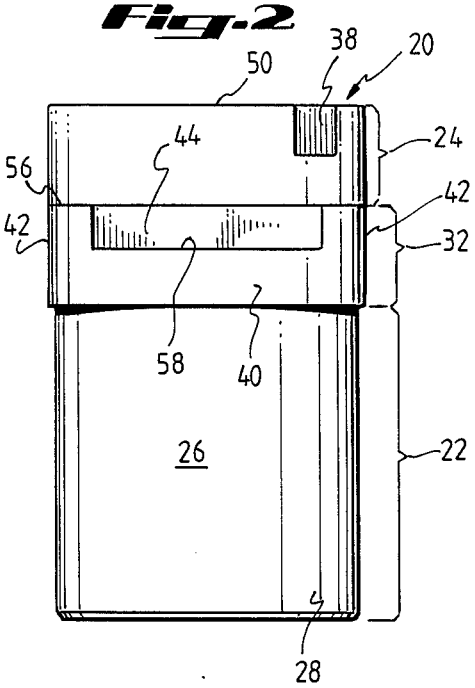
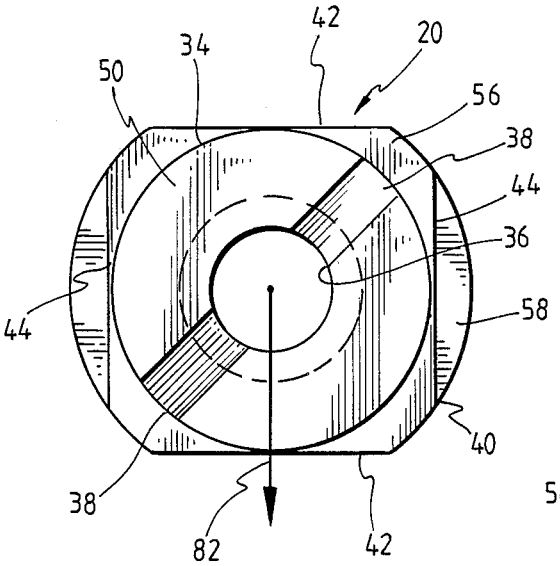
Fig. 5
Fig. 3
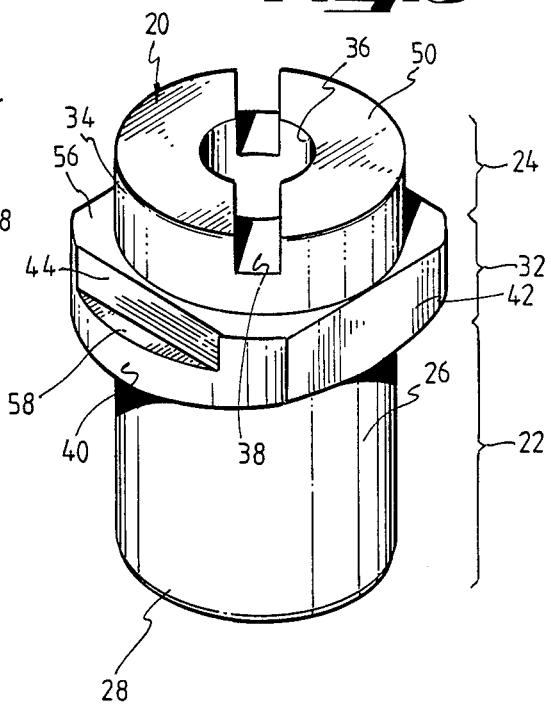

74
36
60
74
34
44
10
6
6
59
44
72
86
58
32
40
20
80
70
26
78
84
77
68
30
66
28
64
62

56
34
36
42
38
76

58
40
40
44
44
74
74
75
76
42
73

Fig.7
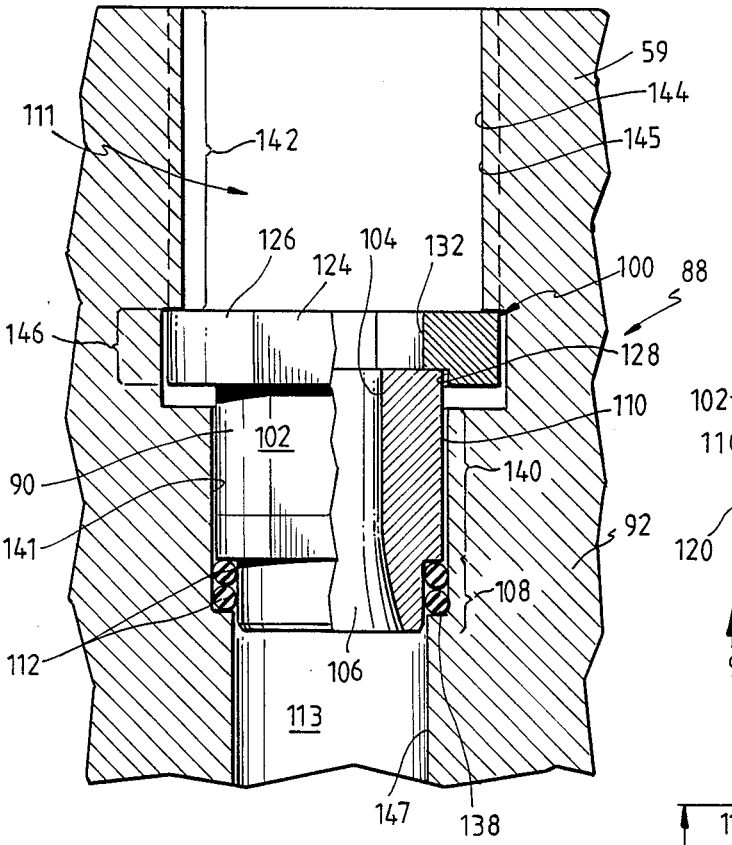
Fig.8
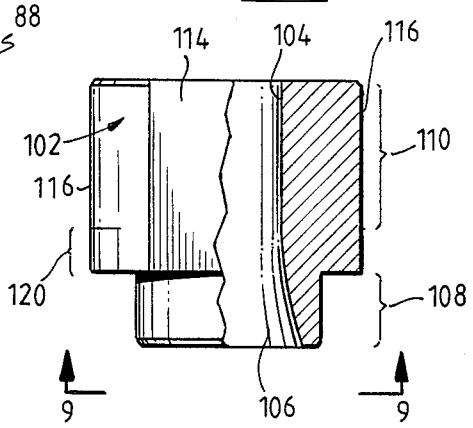
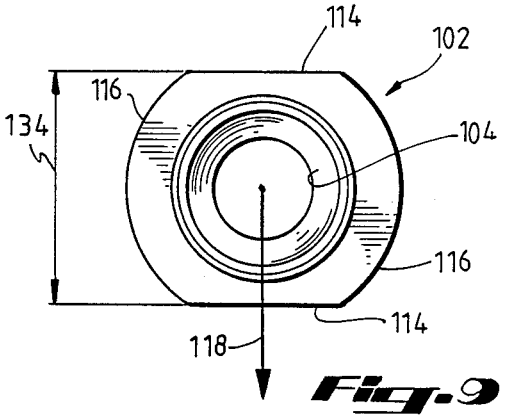
Fig.9
Fig.10
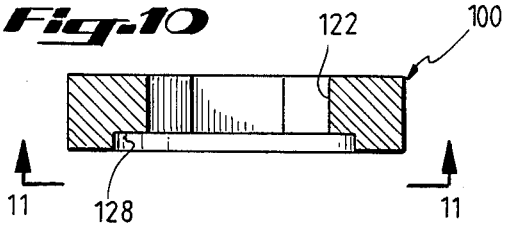
Fig.11
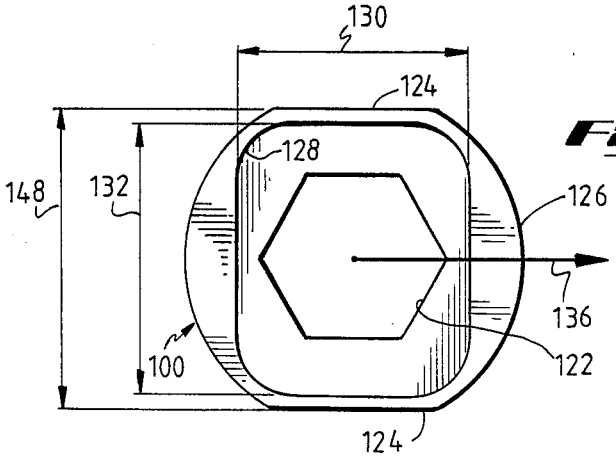

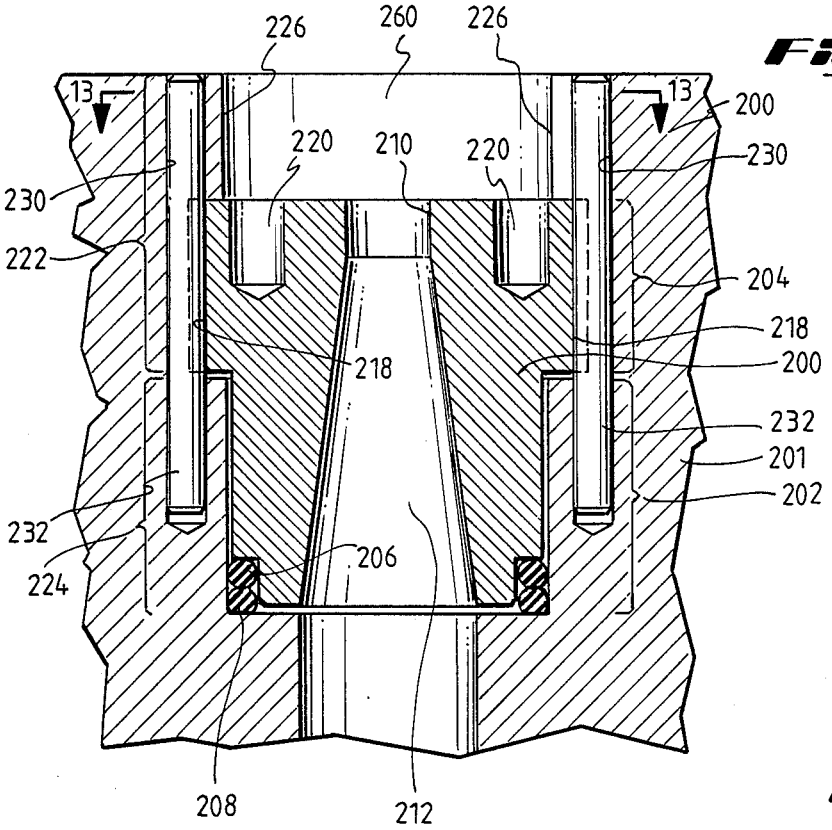
Fig.12
Fig.13
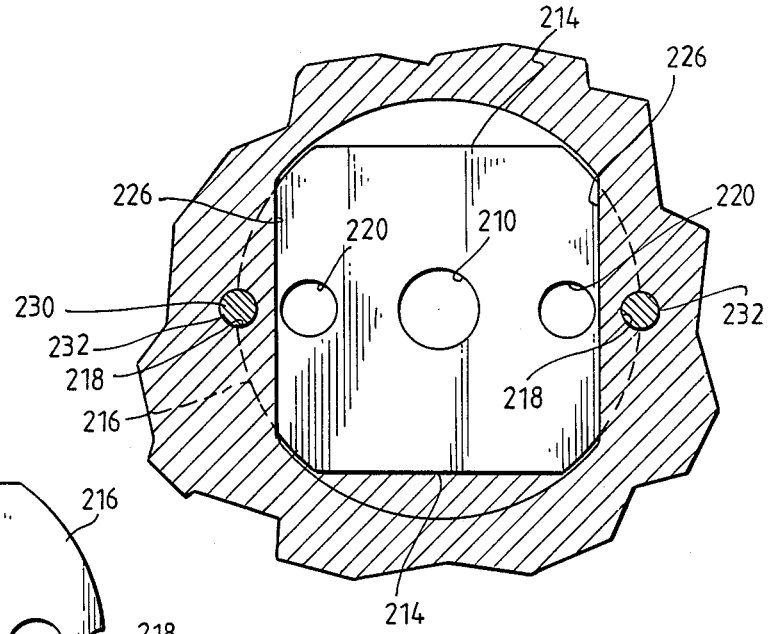
Fig.14
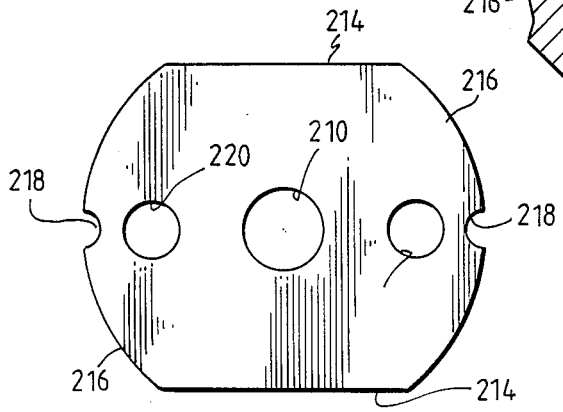

NOZZLE RETENTION SYSTEM FOR A DRILL BIT

BACKGROUND OF THE INVENTION

1. Field of the Invention

The invention relates generally to drill bits, and, in particular, to systems for retaining hydraulic nozzles in drill bits.

2. Description of the Prior Art

Regardless of whether a drill bit is a roller cone bit or drag bit, drilling mud or hydraulic fluid is provided as part of the bit design for the purposes of cooling and cleaning the bit. It has been long known that the functions of the hydraulic subsystem within a drill string can be materially assisted by providing nozzle passages for the hydraulic mud from the interior of the drill bit to form a jet flow toward the point where the cutters engage the bottom of the hole. The drilling mud, however, is extremely abrasive and is supplied under high pressure. As a result, hydraulic nozzles are subject to a highly erosive jet stream. Even though the nozzles are made of tungsten carbide or other hardened metals, they must be frequently replaced, inasmuch as the nozzles will erode, in many cases long before the drill bit becomes worn.

Some bits have nozzles that are permanently fixed into place either by molding, brazing or welding. The prior art has also developed replaceable nozzles. Typically, such replaceable nozzles are retained in the bit against the high hydraulic pressure by various combinations of snap rings and grooves. Because of the high pressure and erosive nature of the drilling mud, replaceable nozzles retained by a combination of a snap ring disposed in a groove defined in the bit body have typically been susceptible to nozzle loss. This has typically resulted either because the portion of the bit body adjacent to the snap ring groove has been washed away or because portions of the nozzle body and snap ring have been eroded.

Because of the unsuitability of snap ring replaceable nozzles, various other types of replaceable nozzles have been devised in the prior art which either place the snap ring away from a position where it can erode or provide an end-cap which threads into the bit body to retain the nozzle. Alternatively, the nozzle itself may be threaded directly into the bit body. One such example is found in a tungsten carbide molded nozzle which is described in U.S. Pat. No. 4,567,954, assigned to the same assignee as the present invention. Other prior art examples of threaded nozzles are shown and discussed, for example, in Radtke, "Drill Bit Nozzle", U.S. Pat. No. 4,381,825.

Examples of threaded nozzles which incorporate a retaining ring can also be found in Thomas, "Nozzle Retention Method for Rock Bit", U.S. Pat. No. 4,407,378, which shows a resilient nozzle having a plurality of radially circumferential fins which are jammed in the nozzle bore defined in the bit body.

Another example of a threadless nozzle not incorporating a retaining ring is shown by Goolsbee, "Quick Change Slush Nozzle", U.S. Pat. No. 2,520,362, wherein a multiple part nozzle is formed into two telescopic shapes which wedge together and are retained in place by the last boot.

Long tubular nozzles having an expanded internal end-flange, which is mounted in a mating indentation in the interior of the bit body, can be found in Mori, "Retrievable Jet Bit with Swing Jets", U.S. Pat. No. 3,393,756.

Threaded nozzles are not satisfactory for several reasons. The threads for the nozzles are difficult to form in certain types of bit construction. Additionally, the nozzles are relatively difficult, if not impossible, to replace, due to the substantial erosion and other damage which the threads typically receive in the drilling environment.

What is needed is a simple, rugged, system for a threadless replaceable nozzle which is not subject to erosion of the nozzle retaining system, and which allows simple and quick insertion and replacement of the nozzle.

SUMMARY OF THE INVENTION

The present invention provides a nozzle which may be inserted and retained in a drill bit or similar apparatus by means of simple longitudinal and rotational movement. In a preferred embodiment, the body member of the drill bit will include a bore for receiving the nozzle. This bore will be defined by sidewalls which form a keyway, which, in turn will define contact surfaces at its lower end for engaging a nozzle. In this preferred embodiment, the nozzle will include outwardly extending flanges which are adapted to pass through the keyway in a first orientation and to be retained beneath the keyway, and against the contact surfaces, when the nozzle is in a second, rotated, orientation. A resilient force will preferably be applied to the nozzle, such as by a coil spring disposed around the nozzle and contacting the body member. This resilient force will act upon the nozzle, and will urge the nozzle into engagement with the contact surface beneath the keyway when the nozzle is in its second orientation.

In a particularly preferred embodiment, the nozzle will include surfaces, such as in the form of flanges, which exhibit a stepped profile. This stepped profile will be adapted to allow the nozzle to move longitudinally to non-rotatably engage the body member when the nozzle is rotated to its above-described second orientation. The stepped profile, therefore, prevents the removal of the nozzle without both longitudinal movement compressing the spring and rotational movement to bring the stepped contact surface of the nozzle out of engagement with the contact surface of the body member.

BRIEF DESCRIPTION OF THE DRAWINGS

FIG. 2 is a side view of the nozzle element of the nozzle retention system of FIG. 1.

FIG. 3 is a perspective view of the nozzle of FIG. 2.

FIG. 4 is a side view of the nozzle of FIG. 2 from a position perpendicular to the view of FIG. 2, depicted partially in vertical section.

FIG. 5 is a top plan view of the nozzle of FIG. 2.

FIG. 7 is a side view of a second embodiment of a nozzle retention system in accordance with the present invention, depicted partially in vertical section.

FIG. 8 is a side view of the body portion of the nozzle of FIG. 7, depicted partially in vertical section.

FIG. 9 is a bottom plan view of the body portion of the nozzle of FIGS. 7 and 8.

FIG. 10 is a side view of the cap portion of the nozzle of FIG. 7, depicted in vertical section.

FIG. 11 is a bottom plan view of the cap portion of the nozzle of FIGS. 7 and 10.

FIG. 12 is a side view of a third embodiment of a nozzle retention system in accordance with the present invention, depicted in vertical section.

FIG. 13 is a top plan view of the nozzle retention system of FIG. 12 as seen along lines 13—13 of FIG. 12.

FIG. 14 is a top plan view of the nozzle of FIGS. 12 and 13.

DETAILED DESCRIPTION OF THE PREFERRED EMBODIMENT

Figure 1:
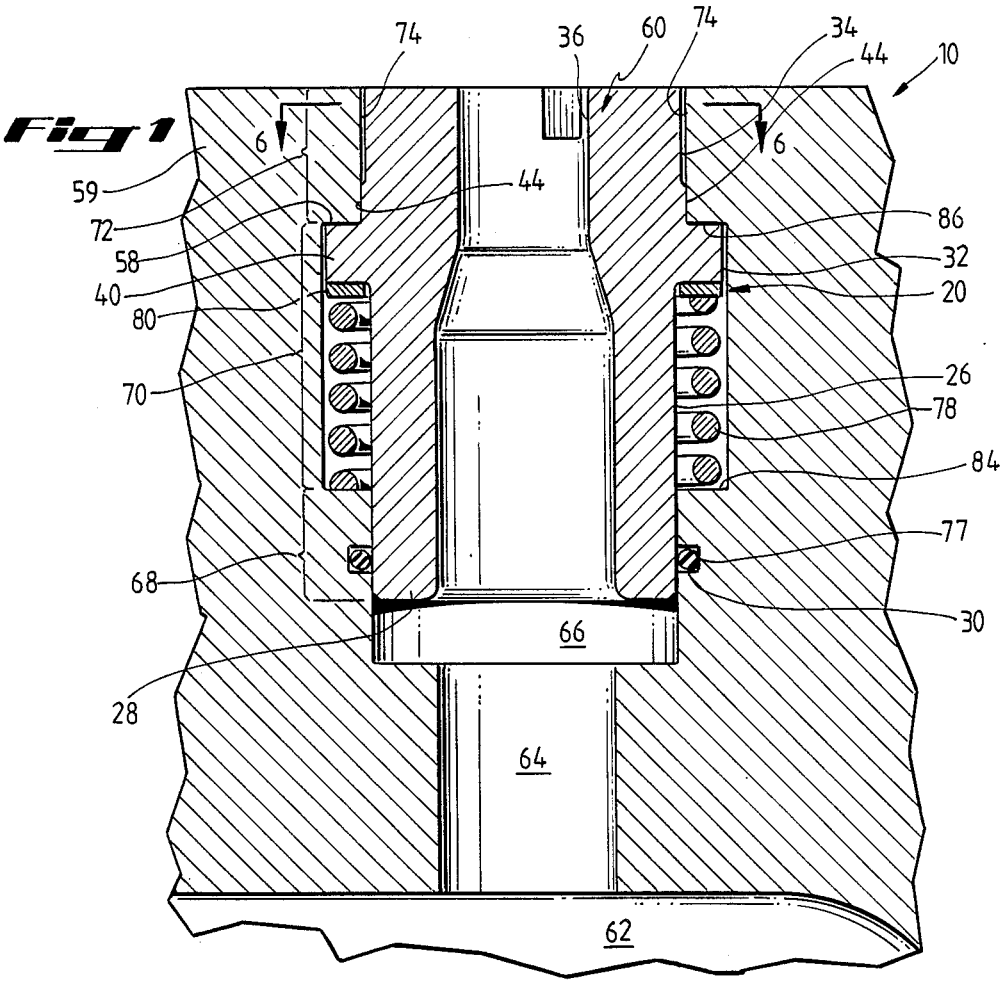
FIG. 1 is a side view of a nozzle retention system in accordance with the present invention, depicted in vertical section.
Figure 6:
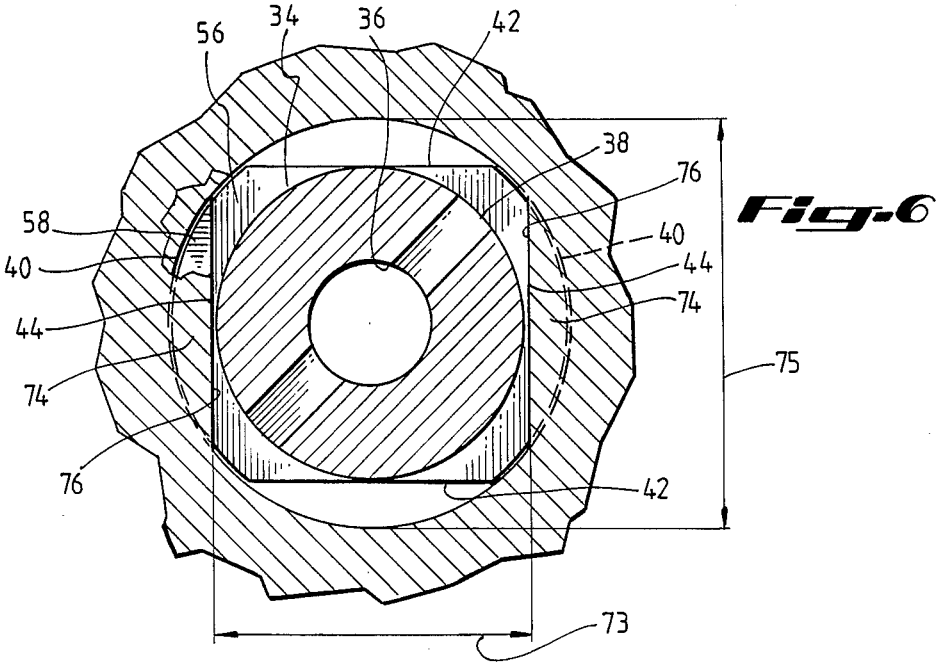
FIG. 6 is a top plan view of the nozzle retention system of FIG. 1 taken along lines 6—6 of FIG. 1.

Referring now to FIGS. 1–6, and particularly to FIG. 1, therein is depicted a nozzle retention system 10 in accordance with the present invention. Nozzle retention system includes a nozzle 20 which is cooperatively conformed with nozzle bore 66 in a drill bit body, depicted in pertinent part at 59. Nozzle 20 is a unitary member which includes a lower body portion, denoted generally by reference numeral 22, and an upper body portion, denoted generally by reference numeral 24. Lower body portion 22, in turn, includes a cylindrical portion 26 of a first diameter. Upper portion 24 includes a cylindrical portion 34 which is of a second diameter, which is generally greater than the first diameter of lower portion 22, and which includes a nozzle orifice 36. Nozzle 20 also includes a flange, indicated generally at 32. Upper portion 24 preferably includes a drive slot 38 which extends diametrically across upper portion 24 and is adapted to receive the extending blade of a drive tool (not shown) which may be used to facilitate rotation of nozzle 20 within nozzle bore 66 in drill bit body 54.

Flange 32 of nozzle 20 preferably includes two radially extending, generally curvilinear, segments, indicated generally at 40. Radial segments 40 are arranged in opposed relationship to one another on nozzle 20. Extending between radial segments 40 are two opposing flat segments 42. Radial segments 40 of flange 32 are each provided with a flat surface 44, proximate their upper half which defines a shelf portion 58 on each segment 40.

Nozzle 20 includes a longitudinal axial bore 36. In the depicted embodiment, axial bore 36 opens broadly to its maximum extent at the innermost end 48 of nozzle 20. Thereafter, bore 36 restricts to a smaller internal diameter narrowing to the outermost end 50 of nozzle 20. The smaller diameter or bore 36 near end 50 of nozzle 20 is smoothed into the larger diameter (near opposing end 48), through a smooth radius in a transition zone 52. Axial bore 36 may assume virtually any known or desired configuration.

As illustrated in FIGS. 2, 3 and 5, flat segments 42 of flange 32 are approximately flush with the outer diameter of upper portion 24. Flat surfaces 44 on each radial segment 40 of flange 32 preferably extend perpendicularly between flat segments 42, and may be offset slightly from the diameter of upper portion 34 of nozzle 20. Each opposing, curvilinear, radial segment 40 of flange 32 circumscribes somewhat more than 90 degrees of the azimuthal periphery of flange 32. The described configuration serves to establish an upper shelf 56, having maximal area at each of the upper four corners of flange 32. Flange 32 forms a key which is selectively engageable and disengageable with keyway 74 in nozzle bore 66, as will be discussed in more detail later herein. As is described below, shelves 58 serve as a locking mechanism whereby nozzle 20 can be selectively replaced and secured in nozzle bore 66 in bit body 59.

By way of example only, in the embodiment of nozzle 20 depicted in FIGS. 1–6, nozzle 20 is approximately 1.463 inches in length. Lower body portion 22 has a longitudinal length of approximately 0.906 inch, and flange 32 has a longitudinal length (heigth) of approximately 0.439 inch. The longitudinal length of upper portion 24 of nozzle 20 is approximately 0.118 inch. The diameter of upper portion 24 (and the distance between flat segments 42), is approximately 0.925 inch while the diameter of lower portion 22 is approximately 0.882 inch. Similarly, the maximum diameter of flange 32, across the opposed ends of radial segments 40, is approximately 1.156 inch.

The drill bit body 59 incorporating nozzle retention system 10 has a bore, indicated generally by reference 60, defined therein. Bore 60 communicates with an interior cavity 62 which is supplied with hydraulic fluid from the interior of the drill string during a drilling operation. Hydraulic fluid communicates from interior cavity 62 through a conduit section 64 of bore 60. Conduit 64 communicates with a nozzle bore section, denoted generally by reference 66, in which nozzle 20 is disposed.

Nozzle bore section 66 includes several internal profiles. A first, lower, portion 68 of bore 66 as an inner diameter sufficient to clear the outer diameter of lower portion 22 of nozzle 20. Included within first section 68 is a peripheral O-ring groove 30. First portion 68 extends to a second portion 70, which is diametrically enlarged relative to first portion 68. Second portion 70 of bore 66 has an inner diameter sufficient to accommodate flange 32. The clearances between bore sections 68 and 70 and nozzle 20 are such that nozzle 20 may be easily rotated within the bore through use of a hand tool. Second portion 70 extends to third bore section 72 which is generally characterized as a keyway 74. Specifically, third section 72 may be considered as a cylindrical section, with the same diameter as bore section 70, except that the bore is truncated on two opposing sides by shelves formed by two opposing, generally parallel, walls 76 which extend into bore section 72 to establish a first, reduced, dimension 73 between faces 76, relative to the diametrical dimension 75 across section 72 (90° removed).

Prior to the installation of nozzle 20 in bit body 59, a conventional O-ring 77 is placed in groove 30. When nozzle 20 is installed in bit body 59, O-ring 77 is compressed between the wall of lower section 68 of bore 66 and lower portion 22 of nozzle 20. O-ring 77 thus provides a hydraulic seal between nozzle 20 and bit body 59. Also, prior to installation of nozzle 20 in bore 66, a spring mechanism will be placed around lower portion 22 of nozzle 20 (that portion beneath flange 32). This spring mechanism will preferably be a coil spring 78. A washer 80 may also be placed around lower portion 20, between spring 78 and flange 32 to provide a bearing surface between flange 32 and spring 78. Coil spring 78 will preferably be adapted, in a conventional manner, to provide approximately 42–αpsi of force on flange 32 when nozzle 20 is installed in bit body 59. Optionally, coil spring 78 will exert approximate 50 psi on flange 32. The force on nozzle 20 is adapted to keep nozzle 20 in its installed position against an anticipated pressure differential when the drill string is lowered initially into the well bore.

After O-ring 77 has been installed in groove 30, and spring 78 has been placed around nozzle 20, nozzle 20 may be inserted and secured within bore 66 of bit body 59. Nozzle 20 is oriented with flat segments 42 of flange 32 aligned with flat segments 76 of extending keyway 74 of bore 60. Nozzle 20 may be seated within bore 66 until coil spring 78 abuts shoulder 84 of bore section 70 and supports nozzle 20. Continued downward manual pressure will force upper shelf 56 of flange 32 below shoulder 86 of keyway 74. Nozzle 20 is then rotated approximately 90 degrees and the downward pressure is released. Nozzle 20 will then lock into position under the urging of spring 78.

Nozzle 20 is then locked into position and cannot be further rotated by virtue of the adjacent positioning of flat surface segments 44 and 76. Nozzle 20 cannot be blown out of orifice 62 due to hydraulic pressure applied thereto from cavity 62 by virtue of the abutment of nozzle 20 against keyway 74. Similarly, vibrations in the bit body, even when severe, are insufficient to drive nozzle 20 inwardly into the bit body against the resilient force of spring 78 to a degree sufficient to move surface segment 44 out of abutting contact with surfaces 76 of keyway 74. Thus even the possibility of rotation of nozzle 20 is substantially unlikely. The existence of an inward force applied to nozzle 20 of sufficient magnitude to allow clearance of surfaces 44 and 76, in combination with a rotary force of sufficient strength and magnitude to rotate nozzle 20 sufficiently to free it form keyway 74 is, for all practical purposes, impossible.

Referring now to FIGS. 7–11, therein is depicted an alternative embodiment 88 of the present invention. FIG. 7 depicts the alternative embodiment of the invention wherein a nozzle 90 is shown in cross-sectional view as inserted in a bit body 92. Nozzle 90 includes a nozzle cap 100 and nozzle body 102. Nozzle body 102 defines a nozzle orifice 104 and is characterized by a longitudinal nozzle bore 106 through which the hydraulic fluid flows from a hydraulic conduit 113 in the same manner as described in connection with the embodiment of FIGS. 1–6. Nozzle body 102 is an integral member including two cylindrical portions, a first, lower, cylindrical portion 108 of a first diameter and a second, upper, partially cylindrical portion 110 of a larger diameter. The otherwise cylindrical shape of upper portion 110 has been modified by the inclusion of two opposed flat surfaces 114. Separating opposing flat surface segments 114 are two curvilinear opposing segments 116.

Lower portion 108 is sized to accommodate a spring mechanism when nozzle body 102 is installed in bit body 92. Spring mechanism may again be a coil spring or may be a plurality of resilient O-rings 138. For example, O-rings with an enhanced elasticity could be used, such as those sold under the trademark "Quad Rings" by Busak & Luyben Dichtugen of West Germany.

Nozzle cap 100 is best illustrated in the cross-sectional side view of FIG. 10 and in the bottom plan view of FIG. 11. Nozzle cap 100 is a partially cylindrical disk. Cap 100, like body 102, includes two opposing flat surface segments 124 separated by two opposing curvilinear segments 126. A hexagonal drive aperture 122 is symmetrically defined through cap 100, such that when nozzle cap 100 is installed over nozzle body 102 in a bit, as shown in FIG. 7, aperture 122 is aligned with orifice 104 of body 102. Hexagonal drive hole 122, which is arranged and configured to mate with a hexagonal driving tool (not illustrated), is broadened to form a rounded, but generally rectangular aperture 128 on the lower surface of nozzle cap 100. Rectangular aperture 128 is preferably symmetrically disposed relative to hexagonal aperture 122. Aperture 128 is adapted to engage upper portion 110 of nozzle body 102 when its flat surfaces 114 are generally perpendicular to flat surface segments 124 of nozzle cap 102. Rectangular aperture 128 may therefore be provided with rounded corners of a radius compatible with the outer diameter of portion 110 of body 102.

For example only, in one embodiment constructed as depicted in FIGS. 7–11, aperture 128 of nozzle cap 100 has a width 130 of 22.6 millimeters and a length 132 of 27.6 millimeters. Nozzle body 102 includes a distance 134 between opposing flat surface segments 114 of 22.2 millimeters, and a dimension between circular cylindrical surfaces 116 of 25 millimeters. Thus, it can be appreciated that when portion 110 of body 102 is adjacent to aperture 128 of cap 100, as when disposed in bit body 92, and when radial axis 118 of nozzle body 102 is generally perpendicular to axis 136 of cap 100, the dimension of body 102 will exceed the aligned dimension of aperture 128 of cap 100, preventing the engagement of body 102 and cap 100. However, as cap 100 is rotated, axis 118 of body 102 and axis 136 of cap 100 will ultimately come into generally parallel alignment. When aligned, body 102 will snap into aperture 128 under the resilient force applied to body 102 by O-ring stack 112.

As was the case with the embodiment of FIGS. 1–6, bit body 92 includes a nozzle bore 111 with a molded or machined surface which extends to meet a fluid conduit 113. In the illustrated embodiment, the lower portion of bore 111 has diameter of slightly larger than 22.0 millimeters to allow insertion of lower portion 108 of body 102. Bore 111 then diametrically broadens and forms a shoulder 138 and an expanded bore section 140. Shoulder 138 provides a capturing shoulder for stacked O-rings 112 and bore section 140 has a diameter sufficient to allow insertion of nozzle body 102 therein. Stacked O-rings 112 thus provide both a resilient force against nozzle 20 and a hydraulic sealing means between nozzle 90 and bore 60.

Bore section 140 is provided with two opposing surfaces 141 which are arranged and configured to accept insertion of nozzle body 102 only if flat surface segments 114 of nozzle body 102 are aligned with surfaces 141. Surfaces 141 do not extend throughout bore section 140, but stop short of the lower dimension of bore section 140. Accordingly, a lower section 147 of bore 140 exhibits a generally cylindrical bore. Nozzle body 102 cannot rotate in bore section 140 by virtue of the abutment of surfaces 141 with surfaces 114.

The upper portion of bore 111 is partially cylindrical, but includes a keyway 144 formed by two opposing surfaces 145 having a separation distance slightly larger than width 148 of cap 100. Otherwise, bore section 142 is characterized by a circular cylindrical diameter of slightly more than that of the diameter of cap 100.

When nozzle 90 is to be disposed in bit body 92, nozzle body 102 is first disposed in bore 111, with O-rings 112 installed, and aligned with keyways 141 in bore section 140. Thereafter, cap 100 is aligned with keyways 144 so that the inner surfaces of keyways 144 are adjacent to flat surface segments 124 of cap 100, to allow passage of cap 100 through bore section 142. Cap 100 is disposed entirely through bore section 142 and into bore section 146. When cap 100 is disposed in bore section 142, flat surface segments 124 of cap 100 are similarly aligned with flat surface segments 114 of body 102 (and consequently with the surfaces of keyway 144). However, in this orientation, aperture 128 in cap 100 will be orthogonally misaligned with the top surface of body 102. Thereafter manual pressure is applied to cap 100, and thus body 102, to compress O-ring stack 112. The compression of cap 100 and body 102 against O-ring stack 112 is sufficient to further depress cap 100 and body 102 further into bore 60 so that cap 100 is fully disposed within bore section 146. Thereafter, cap 100 is rotated approximately 90 degrees within bore section 146 by a hexagonal tool (not shown) disposed into aperture 122 and rotated 90 degrees within bore section 146. Nozzle body 102 will then snap into alignment with aperture 128 and will lock into position with cap 100.

Referring now to FIGS. 12–14, therein is depicted another alternative embodiment of a nozzle installation in accordance with the present invention. FIG. 12 illustrates a cross-section view of a nozzle 200 installed in bore 260 of bit body 201. Nozzle 200 is generally cylindrical and is characterized by a lower, generally cylindrical, portion 202 and an upper, partially cylindrical, portion 204. Lower cylindrical portion 202 has a reduced diameter relative to upper portion 240 and also includes a peripheral O-ring groove 206 at its lower end. One or more O-rings 208 are disposed in O-ring groove 206 to provide hydraulic sealing between nozzle 200 and the adjacent walls of nozzle bore 260.

Nozzle 200 includes an orifice 210 and an axial nozzle bore 212. Upper portion 204 of nozzle 200 again includes opposing flat segments 214. Flat segments 214 are separated by two opposing circular segments 216. Opposing circular segments 216 preferably include generally semi-circular broaches 218, placed in generally diametrically opposing relation to one another. Broaches 218 are located on a diameter of nozzle 200. On the same diameter are a pair of diametrically opposing drive holes 220. Drive holes 220 are blind circular bores into upper portion 204 of nozzle 200 which provide a means by which a mating drive tool can be inserted into the top face of nozzle 200 to turn it.

Bore 260 of bit body 201 includes an upper bore section 222 and a lower bore section 224. Lower bore section 224 is generally cylindrical and has a reduced diameter sized to accommodate lower portion 202 of nozzle 200. Bore section 222 is a partially cylindrical and circular bore having a diameter large enough to accommodate the diameter of nozzle 200 and in particular circular segments 216. Upper bore section 222 has an integral keyway 226 integrally formed into bit body 201. The walls defining keyway 226 again extend longitudinally only partially through bore section 222. Beneath the walls, keyway 226 includes a fully cylindrical bore portion 204 of a sufficient diameter to accommodate the diameter across cylindrical segments 216.

Bit body 201 has a pair of opposing bores 230, each through or adjacent to one keyway 226 and extending generally parallel to the longitudinal axis of nozzle bore 260. The depth of each bore 230 is sufficient to extend past the lower edge of bore section 222, and ends in a blind hole. Rigid pins 232 will be placed in bores 230 after placement of nozzle 200 into nozzle bore 260 to lock nozzle 200 therein. Pins 232 may be made of steel, plastic, or any other hard, rigid material.

When nozzle 200 is to be installed in bit body 201, nozzle 200 is oriented so that flat segments 214 are aligned with the corresponding flat surfaces of keyways 226 in bore section 222. Nozzle 200 can then be slipped downwardly within nozzle bore 260 between keyway 226 to a position where nozzle 20 bottoms out against the bottom of bore section 224. A tool (not shown) can then be engaged with drive holes 220, and nozzle 200 is rotated approximately 90 degrees to bring circular segments 216 in keyway 226 and to further bring broaches 218 into alignment with bores 230 in bit body 200. Once broach 218 and bores 230 are aligned, pins 232 may be disposed within bores 230 and broaches 218 to be embedded beneath the surface of bit body 201. Rotation of nozzle 200 is thereby prevented. Nozzle 200 can be removed by drilling out pins 232 or by driving them past the bottom of bores 222, rotating nozzle 200 and pulling it from bore 260.

It must be understood, many other modifications and alterations may be made by those having ordinary skill in the art without departing from the spirit and scope of the invention. For example, rather than the nozzle being rotatable within the bit body, a portion of the bit body could be made to rotate relative to the remainder of the bit and the nozzle to retain the nozzle in position. Additionally, forms of key and keyway configurations other than those depicted herein may be utilized. Accordingly, the embodiments described and illustrated herein are illustrative only and are not to be considered as limitations upon the present invention.

We claim:

1. A drill bit, comprising:

a body member, said body member having a bore for receiving a nozzle, said bore having a profile forming a keyway;

a nozzle, said nozzle including a key portion adapted to selectively engage said keyway in a first position to retain said nozzle within said bore of said body member, and to disengage said keyway in a second position to disengage said nozzle from said body member; and a spring disposed generally coaxially with said nozzle, and externally relative to said nozzle, and adapted to exert a force on said nozzle to selectively retain said nozzle in said first position.

2. The drill bit of claim 1, wherein said nozzle is a unitary member.

3. The drill bit of claim 1, wherein said nozzle comprises a body member and a cap member, and wherein said cap forms said key portion of said nozzle.

4. The drill bit of claim 1, wherein said nozzle is a unitary member, and wherein said nozzle is rotatable within said bore.

5. A system for retaining a nozzle in a bore within the body of a drill bit, comprising;

a receiving section in the bore of said drill bit, said receiving section having a first portion including a non-circular opening and a second portion forming a recess which abuts said first portion;

a nozzle configured to traverse said first portion of said receiving section in a first position relative to said body, and adapted to be retained in said second portion of said receiving section when said nozzle is in a second position relative to said body, and wherein one of said first portion of said receiving section and said nozzle is rotatable relative to the other, said nozzle being adapted to pass a pressurized fluid through said body;

a resilient mechanism adapted to exert a force on said nozzle when said nozzle is in said second position relative to said body; and means for isolating said resilient mechanism from said pressurized fluid.

6. A method of securing a nozzle within a drill bit, comprising the steps of:

establishing a bore within said drill bit, said bore having a profile to form a keyway;

placing a nozzle in said bore, said nozzle including a key portion adapted to selectively engage and disengage said keyway of said drill bit; and rotating said nozzle within said bore to engage said keyway and be retained within said drill bit;

exerting a force on said nozzle through use of a resilient member at least when said nozzle is in said engaged relation with said keyway; and sealing said bore and said resilient member from fluid which passes through said nozzle.

7. A drill bit, comprising:

a body member having a bore therein for receiving a nozzle, said body member having at least one portion extending into said bore to define a keyway in said bore;

a nozzle having a contact surface configured to pass through said keyway in said bore in a first orientation and to be retained within said bore by said extending portion of said body member when in a second orientation;

a spring mechanism for urging said contact surface of said nozzle toward said extending portion of said body member when said nozzle is in said second orientation; and a seal disposed between nozzle and said body member for isolating said bore and said spring mechanism from fluid being passed through said nozzle.

8. The drill bit of claim 7, wherein said nozzle is unitary member.

9. The drill bit of claim 7 wherein said nozzle is a generally cylindrical member having a plurality of outwardly extending flanges from a generally cylindrical contour.

10. The drill bit of claim 9, wherein said contact surface of said nozzle is formed by a truncated cylinder, said cylinder truncated by opposing generally flat surfaces.

11. The drill bit of claim 7, wherein said nozzle includes two outwardly extending flanges in generally opposed relation, said flanges having a stepped profile, said stepped profile adapted to allow said nozzle to engage said contact surfaces of said body member when said nozzle is in said second orientation and thereby prevent further rotation of said nozzle without longitudinal movement of said nozzle relative to said body member.

12. A drill bit, comprising:

a body member, said body member having a bore for receiving a nozzle, said bore having a profile forming a keyway;

a nozzle, said nozzle including a key portion which allows said nozzle to be inserted into said keyway in a first position, and which allows said nozzle to engage said keyway in a second position after the insertion of said nozzle within said bore of said body member, said nozzle being adapted to pass a pressurized fluid through said body member;

means for resiliently forcing said key portion of said nozzle into engagement with said keyway in said second position to retain said nozzle within said bore; and means for isolating said forcing means from said pressurized fluid.

13. The drill bit of claim 12, wherein said nozzle is a unitary member.

14. The drill bit of claim 12 wherein said isolating means includes a hydraulic seal between said nozzle and said body member when said nozzle is being retained within said bore.

15. The drill bit of claim 12, wherein said resilient means comprises a coil spring.

16. The drill bit of claim 15, wherein said coil spring is disposed generally coaxially and concentrically relative to said nozzle.

* * * * *